US005133488A

United States Patent [19]

Peterson

[11] Patent Number: 5,133,488

[45] Date of Patent: Jul. 28, 1992

[54] FOOTWEAR REMOVER

[76] Inventor: Jerry W. Peterson, P.O. Box 248, Potwin, Kans. 67123

[21] Appl. No.: 715,479

[22] Filed: Jun. 14, 1991

[51] Int. Cl.[5] ..... A47G 25/80

[52] U.S. Cl. ..... 223/114; 223/117

[58] Field of Search ..... 223/114, 115, 116, 117, 223/113, 120

[56] References Cited

U.S. PATENT DOCUMENTS

| | | | |
|---|---|---|---|
| 63,844 | 4/1867 | Boss | 223/114 |
| 84,862 | 12/1868 | Darden | 223/117 |
| 110,743 | 1/1871 | Crabtree | 223/117 |
| 370,197 | 9/1887 | Kennedy | 223/117 |
| 1,636,010 | 7/1927 | Moland | 223/117 |
| 1,893,280 | 1/1933 | Gerfen | 223/115 |
| 3,490,661 | 1/1970 | Williams | 223/114 |
| 3,526,346 | 9/1970 | Drouillard et al. | 223/114 |
| 3,784,067 | 1/1974 | Hicks | 223/114 |
| 3,964,117 | 6/1976 | Fox | 223/114 |
| 4,537,337 | 8/1985 | Girty | 223/114 |
| 4,760,942 | 8/1988 | Kadar | 223/114 |

FOREIGN PATENT DOCUMENTS

| | | | |
|---|---|---|---|
| 3031934 | 5/1982 | Fed. Rep. of Germany | 223/114 |
| 2031264 | 4/1980 | United Kingdom | 223/113 |
| 2144969 | 3/1985 | United Kingdom | 223/114 |

*Primary Examiner*—Werner H. Schroeder
*Assistant Examiner*—Bibhu Mohanty
*Attorney, Agent, or Firm*—John Wade Carpenter

[57] ABSTRACT

A footwear remover having a body portion and a head portion secured to the body portion. The head portion has a plurality of ridges on a top planar surface and a V-shaped recess for receiving a heel of a shoe, boot, or the like. The body portion has a pair of opposed triangular shaped sides which connect to the head portion. The bottom surface includes a plurality of ridges to grip the other shoe during use.

3 Claims, 2 Drawing Sheets

FIG. 1
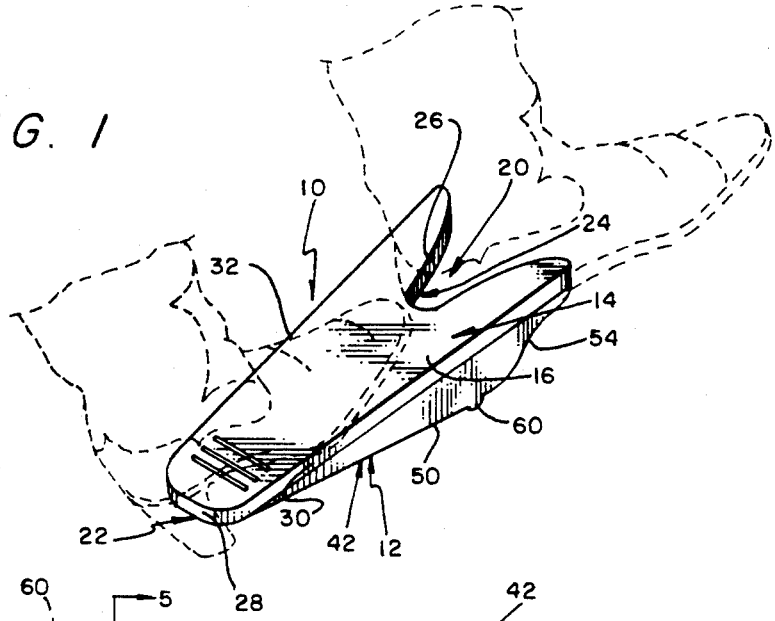
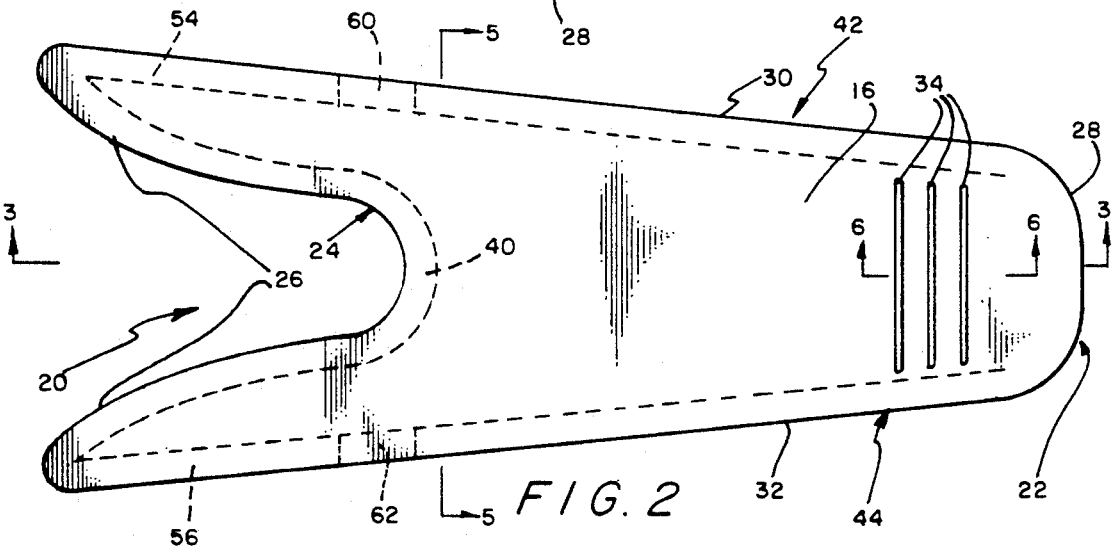
FIG. 2
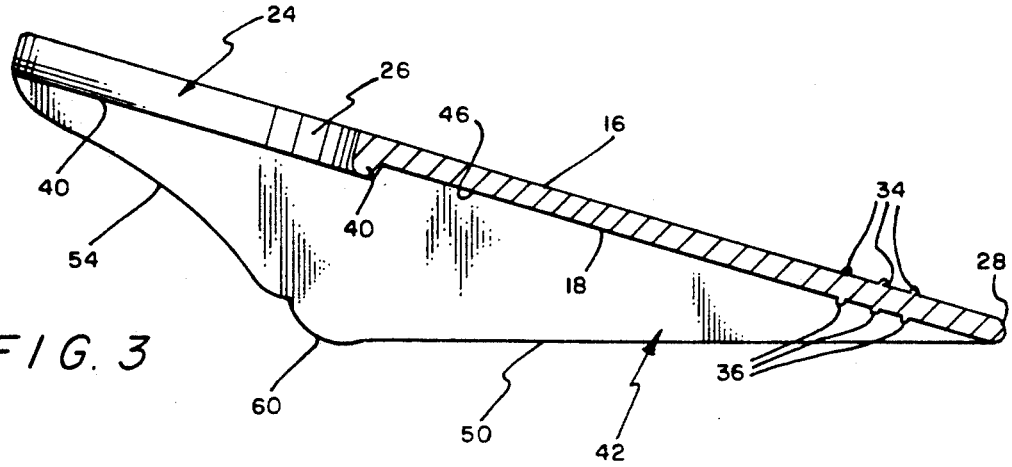
FIG. 3

FIG. 4
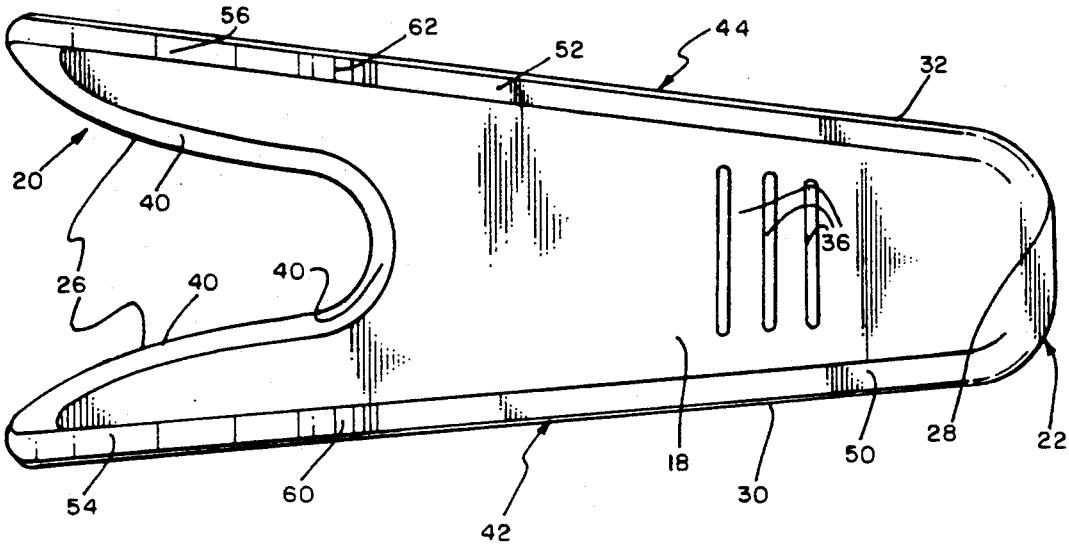
FIG. 5
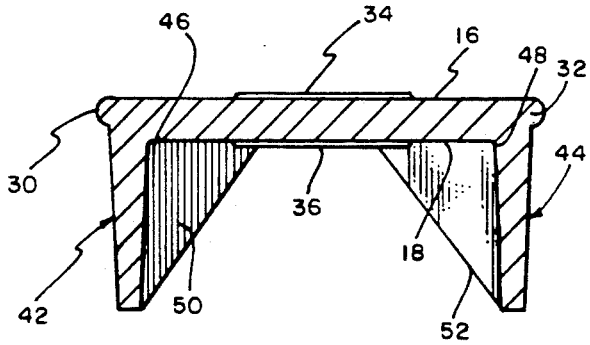
FIG. 6
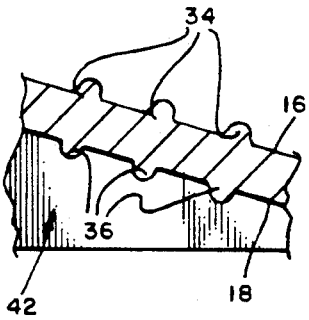
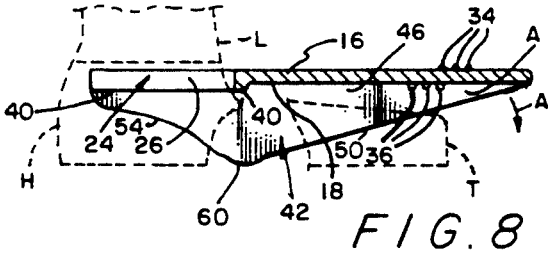
FIG. 8
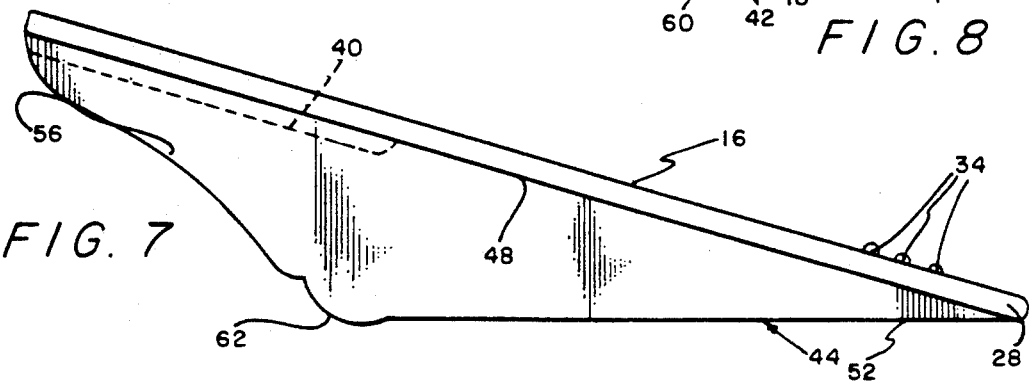
FIG. 7

FOOTWEAR REMOVER

1. Field of the Invention

This invention relates to an apparatus for removing shoes, boots, and the like. More specifically, this invention provides a footwear remover which is portable, economical to manufacture, and relative simple to operate for removing shoes, boots, and the like.

2. Description of the Prior Art

A patentability investigation was conducted and the following U.S. Pat. Nos. were discovered:

| | |
|---|---|
| 63,844 | titled: BOOT JACK, Boss. |
| 84,862 | titled: BOOT JACK, Sarden. |
| 110,743 | titled: BOOT JACK, Crabtree. |
| 204,230 | titled: BOOTJACK, De Andre. |
| 370,197 | titled: BOOT JACK, Kennedy. |
| 1,636,010 | titled: BOOTJACK, Moland. |
| 3,490,661 | titled: FOOTWEAR REMOVAL FACILITATING DEVICE, Williams. |
| 3,784,067 | titled: BOOT JACK, Hicks. |
| 4,760,942 | titled: BOOT LIFTER FOR ELDERLY AND HANDICAPPED, Kaper. |

None of the foregoing prior art U.S. patents teach or suggest the particular footwear remover of this invention.

Summary of the Invention

The present invention accomplishes its desired objects by broadly providing a footwear remover comprising a body portion and a head portion secured to the body portion. The head portion comprises a top generally planar surface and a bottom generally planar surface, both terminating in a first head end and in a second head end with the first head end having a structure defining a generally V-shaped recess having a V-shaped recess border for receiving a heel of a footwear and with the second head end having a structure generally defining a straight edge. The head portion additionally comprises a pair of side edges tapering from the first head end to terminate in the straight edge of the second head end; and the body portion comprises a pair of opposed body sides, with each body side having a general triangular configuration comprising a hypotenuse side, a base side, and a front side. The hypotenuse side connects to the head portion such that each body side extends and tapers from the first head end to the second head end. The base side and the front side terminate in an arcuate surface which protrudes away from the base side and from the front side. The bottom generally planar surface has a surface defining an upper bottom ridge bordering the V-shaped recess border of the generally V-shaped recess. The bottom generally planar surface of the head portion has a surface defining a plurality of lower bottom ridges. The top generally planar surface of the hear portion has a surface defining a plurality of top ridges. The side edges of the body portion each have a generally arcuate shape in vertical cross section. Each of the arcuate shaped side edges of the head portion terminate in the upper bottom ridge which borders the V-shaped recess border.

It is therefore an object of the present invention to provide a footwear remover.

These, together with the various ancillary objects and features which will become apparent to those skilled in the art as the following description proceeds, are attained by this novel apparatus for a footwear remover, a preferred embodiment as shown with reference to the accompanying drawings, by way of example only, wherein;

Brief Description of the Drawing

FIG. 1 is a perspective view of the footwear remover;

FIG. 2 is a top plan view of the footwear remover of FIG. 1;

FIG. 3 is a vertical sectional view taken in direction of the arrows and along the plane of line 3—3 in FIG. 2;

FIG. 4 is a bottom plan view of the footwear remover;

FIG. 5 is a vertical sectional view taken in direction of the arrows and along the plane of line 5—5 in FIG. 2;

FIG. 6 is a vertical sectional view taken in direction of the arrows and along the plane of line 6—6 in FIG. 2;

FIG. 7 is a side elevational view of the footwear remover; and

FIG. 8 is a vertical sectional view of the footwear remover.

Detailed Description of a Preferred Embodiment of the Invention

Referring in detail now to drawings wherein similar parts of the invention are identified by like reference numerals, there is seen a footwear remover, generally illustrated as 10. The remover 10 comprises a body portion, generally illustrated as 12, and a head portion, generally illustrated as 14, connected to the body portion 12.

The head portion 14 has a top generally planar surface 16 and a bottom generally planar surface 18. Both planar surfaces 16 and 18 terminate in ends 20 and 22. End 20 has a generally V-shaped recess 24 with a recess border 26 for receiving a heel of a footwear as best shown by the dotted line representation in FIG. 1. End 22 has a structure defining a straight edge 28. The head portion 14 also has a pair of arcuate shaped side edges 30 and 32 tapering generally inwardly from the end 20 to terminate in the straight edge 28 of the end 22. The top generally planar surface 16 has a plurality of ridges 34 transversely formed on the planar surface 16 for frictionally engaging a footwear as best shown in the dotted line representation in FIG. 1. One footwear or a barefoot rests on the planar surface 16 including the ridges 34 while the V-shaped recess 24 is engaging the heel of a footwear to be removed. Optionally, the bottom planar surface 18 has a plurality of ridges 36 transversely formed on the planar surface 18 for frictionally engaging the top of a toe T (see FIG. 8) of a footwear while another footwear or a barefoot forcedly rests on the top planar surface 16 including the ridges 34 to move the footwear remover 10 in direction of the arrows A and A in FIG. 8. Continuing to reference FIG. 8, the heel H and the ankle or leg L of the user lodge in V-shaped recess 24. The bottom planar surface 18 also has a structure defining a generally V-shaped ridge 40 which is arcuate in vertical cross section and borders the recess border 26 of the V-shaped recess 24. The arcuate shaped side edges 30 and 32 terminate in the V-shaped ridge 40.

The body portion 12 has a pair of opposed body sides 42 and configuration comprising a hypotenuse side or edge 46 and 48 for sides 42 and 44, respectively, and a base side or edge 50 and 52 also for sides 42 and 44, respectively. The triangular configuration for each the body sides 42 and 44 also includes a front side 54 and 56 for sides 42 and 44 respectively.

The hypotenuse sides or edges 46 and 48 connect to the head portion 14 such that body sides 42 and 44 extends and tapers inwardly from the end 20 to the end 22. The base sides or edges 50 and 52 and the front sides or edges 54 and 56 terminate in arcuate surfaces 60 and 62 respectively. Arcuate surfaces 60 and 62 function as a fulcrum as best shown in FIG. 8.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A footwear remover comprising a body portion and a head portion secured to said body portion; said head portion comprising a top generally planar surface and a bottom generally planar surface both terminating in a first head end and in a second head end with said first head end having a structure defining a generally V-shaped recess having a V-shaped recess border for receiving a heel of a footwear and with said second head end having a structure generally defining a straight edge, said head portions additionally comprising a pair of side edges tapering from said first head end to terminate in said straight edge of said second head end; and said body portion comprising a pair of opposed body sides, with each body side having a general triangular configuration comprising a hypotenuse side, a base-side, and a front side an said hypotenuse side connecting to said head portion such that each body side extends and tapers from said first head end to said second head end, and said base side and said front side terminate in an arcuate surface which protrudes away from said base side and from said front side, said bottom generally planar surface has a surface defining an upper bottom ridge bordering said V-shaped recess border of said generally V-shaped recess, and said top generally planar surface has a surface defining a plurality of top ridges laterally extending from said edges, and said bottom generally planar surface has a surface defining a plurality of lower bottom ridge means laterally extending from said sedges for gripping a toe of a second footwear.

2. The footwear remover of claim 1 wherein said side edges each have a generally arcuate shape in vertical cross section.

3. The footwear remover of claim 2 wherein each of said arcuate shaped side edges terminate in said upper bottom ridge which borders said V-shaped recess border.

* * * * *